US009750349B1

(12) United States Patent
Lloyd

(10) Patent No.: US 9,750,349 B1
(45) Date of Patent: Sep. 5, 2017

(54) ARTICULATED FRAME THAT SUPPORTS MOSQUITO NETTING OVER A BED

(71) Applicant: James R. Lloyd, Houston, TX (US)

(72) Inventor: James R. Lloyd, Houston, TX (US)

( * ) Notice: Subject to any disclaimer, the term of this patent is extended or adjusted under 35 U.S.C. 154(b) by 0 days.

(21) Appl. No.: 15/344,731

(22) Filed: Nov. 7, 2016

(51) Int. Cl.
*A47C 29/00* (2006.01)
*A47C 21/02* (2006.01)

(52) U.S. Cl.
CPC ..... *A47C 29/006* (2013.01); *A47C 21/024* (2013.01); *A47C 29/00* (2013.01); *A47C 29/003* (2013.01)

(58) Field of Classification Search
CPC ..... A47C 29/00; A47C 29/003; A47C 29/006; A47C 21/02; A47C 21/022; A47C 21/024
See application file for complete search history.

(56) References Cited

U.S. PATENT DOCUMENTS 193,745 A * 7/1877 Young ..... A47C 29/006 135/90
323,227 A * 7/1885 Snow ..... A47C 29/006 135/87
424,256 A * 3/1890 Bailey ..... A47C 29/006 135/153
1,625,673 A * 4/1927 Nelson ..... A47C 29/006 135/161
1,841,171 A * 1/1932 Clarke ..... A47C 29/006 135/90
2,190,867 A * 2/1940 La Verne ..... A47C 29/006 135/161
2,642,589 A * 6/1953 Cobb ..... A47C 21/024 5/505.1
3,639,001 A * 2/1972 Anderson ..... A47C 4/02 248/188.8
6,901,616 B1 * 6/2005 Warrington ..... A47C 21/024 5/505.1
8,272,086 B1 * 9/2012 Calmes ..... A47C 21/024 5/505.1
2003/0229942 A1 * 12/2003 Dilascio ..... A47C 21/024 5/505.1
2014/0318586 A1 * 10/2014 Watson ..... A47C 21/024 135/90

* cited by examiner

*Primary Examiner* — Nicholas Polito
*Assistant Examiner* — Amanda L Miller

(57) ABSTRACT

This invention provides protection from mosquitoes for an individual lying on a bed. An articulated frame supports mosquito netting over the exposed flesh of the individual. The articulated frame is easily deployed and retracted by the individual while lying on the bed. In the retracted position the bed is fully accessible for making-up or changing the bedding.

6 Claims, 6 Drawing Sheets

SECTION B-B IN FIG. 5

SECTION C-C IN FIG. 7

SECTION A-A IN FIG. 1

SECTION A-A IN FIG. 1

ARTICULATED FRAME THAT SUPPORTS MOSQUITO NETTING OVER A BED

BACKGROUND OF THE INVENTION

Mosquitoes wait at the door to enter a home and then pass through the doorway when the door is opened or they enter through an open window. The mosquitoes then find their way to the bedroom and prey on an individual lying on a bed. This invention provides an easy and inexpensive means of deploying and retracting mosquito netting over the exposed flesh of the sleeping individual lying on the bed. It is assumed that the remaining flesh of the individual not within the protected space is protected by a sheet or blanket. The mosquito netting is held above the individual so that he/she may move in the bed without disturbing the netting or the articulated frame. The mosquito netting can be deployed or retracted by the individual while lying on the bed, and in the process of deployment, transient mosquitoes in the area have a minimal chance of being entrapped in the protected space. In the retracted position, the bed is fully accessible for making-up or changing the bedding.

SUMMARY OF INVENTION

The purpose of this invention is to protect an individual lying on a bed from mosquitoes. An articulated frame is composed of a single horizontal rod supported by two parallel legs attached to the ends of the horizontal rod. The articulated frame straddles the bed, and the bottom of the legs are pivoted below the level of the bed and offset from the head of the bed toward the foot of the bed. The mosquito netting is attached to the horizontal rod and either the headboard of the bed or the wall behind the head of the bed, preferably by clamps. The netting is easily deployed by pulling the mosquito netting toward the foot of the bed and retracted by moving the horizontal rod toward the head of the bed. When deployed, the mosquito netting covers the exposed flesh of the individual sleeping in the bed thereby protecting him/her from mosquitoes. The lower flesh of the individual which is not within the protected space of the mosquito netting is presumed to be protected by a sheet or blanket. When it is necessary to get up in the middle of the night it is very easy to exit and enter the protected space without retracting the horizontal rod, thereby not disturbing a sleeping partner. In the retracted position, the bed is fully accessible for making-up or changing the bedding.

One important and unique feature of this invention is the placement of the pivot point of the articulated frame below the bed and offset from the head of the bed toward the foot of the bed. With this pivot position, the articulated frame is in a stable position when in the retracted position as well as in the deployed position. In the retraced position the articulated frame rests against the headboard or wall behind the head of the bed and will not self-deploy. In the deployed position the articulated frame is restrained by the mosquito netting thereby keeping the mosquito netting taught and preventing it from sagging. Another advantage of this invention is that the mosquito netting can be deployed while lying on the bed and in a manner that minimizes the chance of entrapping a transient mosquito in the protected space. The mosquito netting can also be easily retracted while lying on the bed by reaching up to the horizontal rod and moving it to the retracted position.

DESCRIPTION OF INVENTION

This invention pertains to an articulated frame supporting mosquito netting (hereinafter referred to as netting) over a bed.

Figure 1:
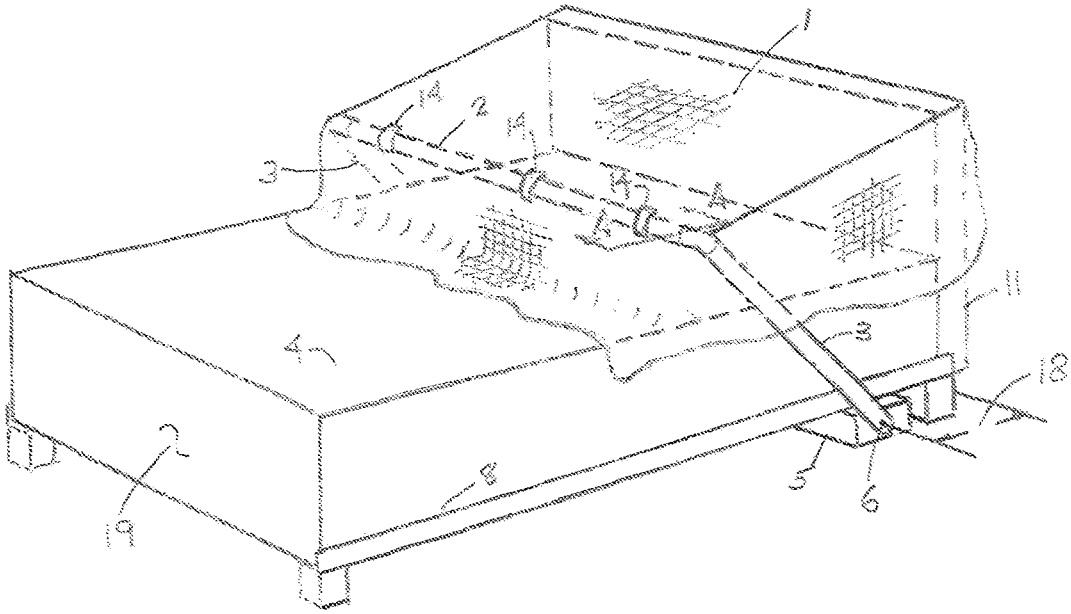
FIG. 1 shows a perspective view of the articulated frame and mosquito netting (hereinafter referred to as netting) in its deployed position over a bed. It illustrates the articulated frame, its components, and the placement of the netting. The legs of the articulated frame are pivoted below the bed and offset from the head of the bed toward the foot of the bed.
Figure 2:
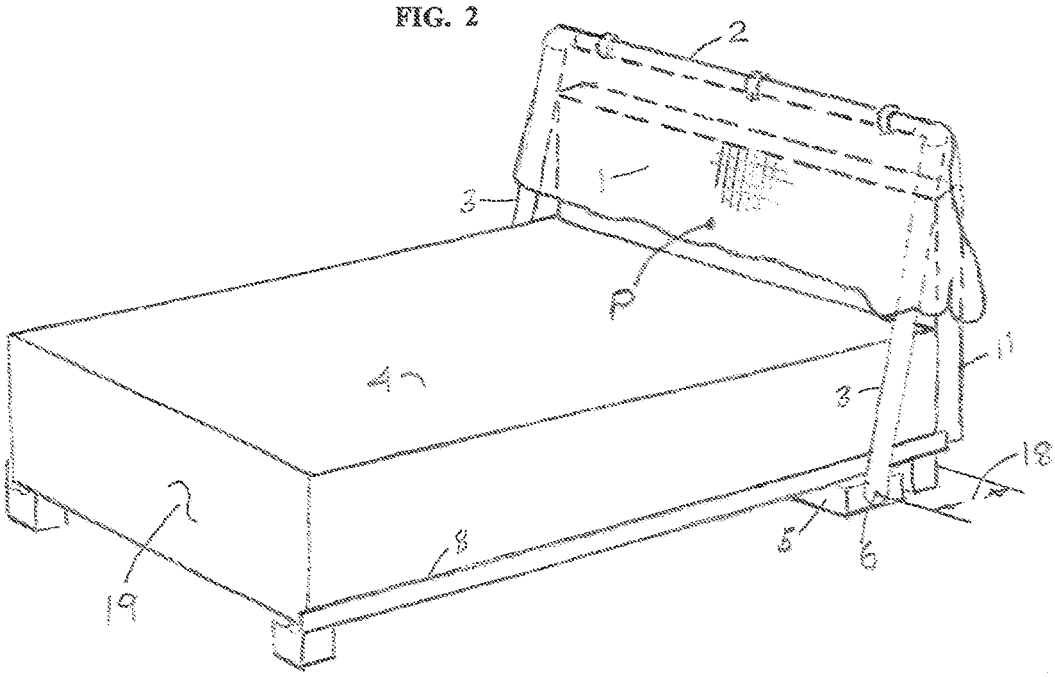
FIG. 2 shows a perspective view of the articulated frame in its retracted position. Note that, because of the pivot offset, the articulated frame is leaning toward the headboard or wall behind the head of the bed.
Figure 3:
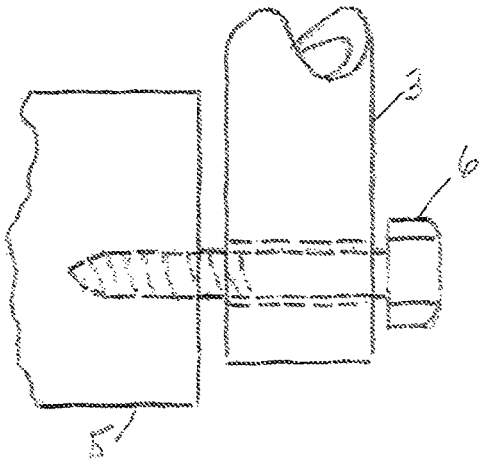
FIG. 3 shows a detail view of the pivot mechanism. It shows how a leg is attached to the end of the board spanning the width of the bed using a lag bolt which serves as the pivot axle.
Figure 4:
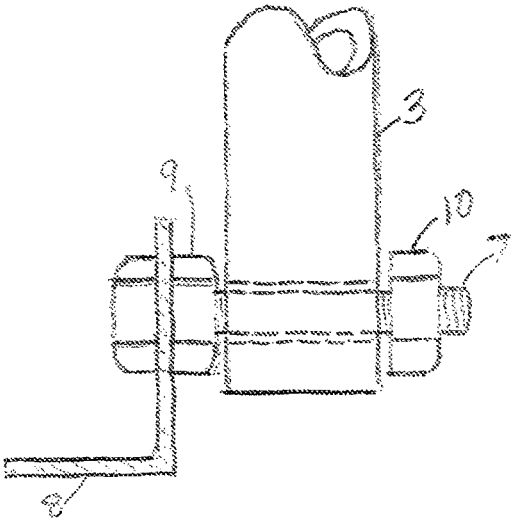
FIG. 4 shows a detail view of an alternative pivot mechanism where the pivot axle is composed of a bolt affixed to the bed frame.
Figure 5:
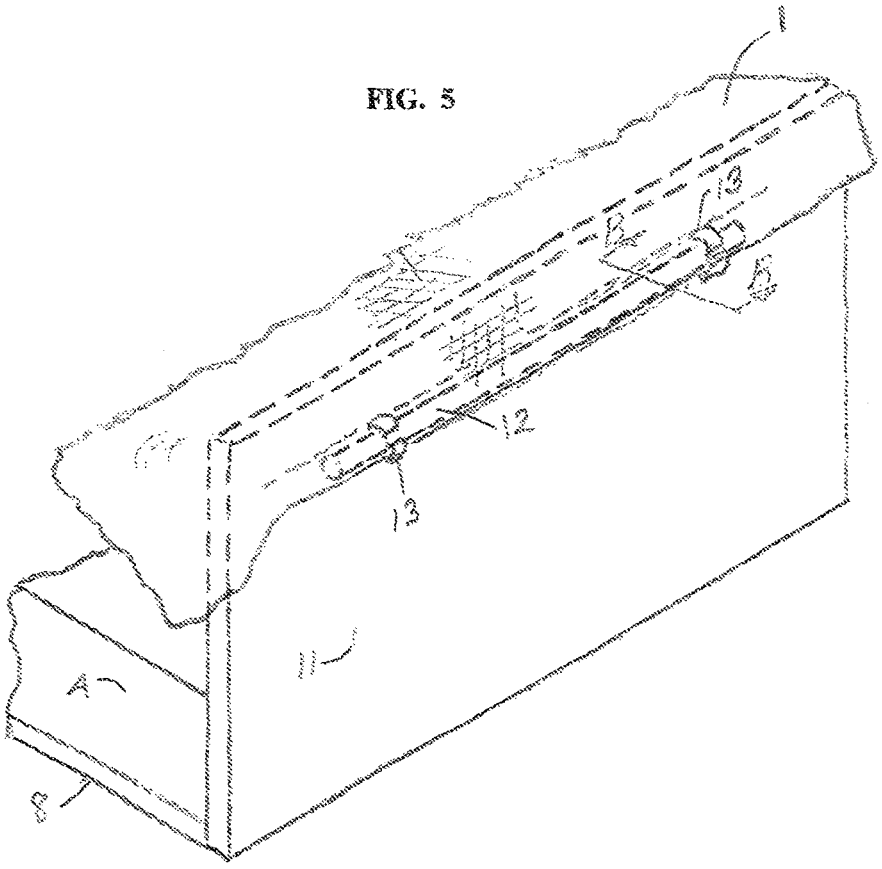
FIG. 5 shows a perspective view of the detail of the attachment of the netting to the back of the headboard using an anchor rod clamped to the headboard.

FIG. 1 shows a perspective view of the articulated frame and netting (1) deployed over a bed (4). FIG. 2 shows the articulated frame and netting (1) in the retracted position. Referring to FIG. 1, the articulated frame is composed of a single horizontal rod (2) with supported by two parallel legs (3) that are attached to the ends of the horizontal rod (2). The horizontal rod (2) spans the width of the bed (4). The legs (3) rotate in a vertical plane about a pivot mechanism on each side of the bed. The preferred pivot mechanism is illustrated in FIG. 1. It is composed of a board (5), which spans the width of the bed (4), and lag bolts (6) which attach the legs (3) to each end of the board (5). The detail of this pivoting mechanism is illustrated in FIG. 3. The lag bolts (6) serve as axles about which the legs (3) can pivot. An alternative pivoting mechanism is illustrated in FIG. 4. It consists of a bolt (7) passing through the bed frame (8), an anchor nut (9) and a cap nut (10). The pivots (6) are located below the bed (4) and offset (18) toward the foot (19) of the bed from the head of the bed. As shown in FIG. 1 and FIG. 5, the netting (1) is attached to the horizontal rod (2) and the headboard (11) of the bed (4).

Figure 6:
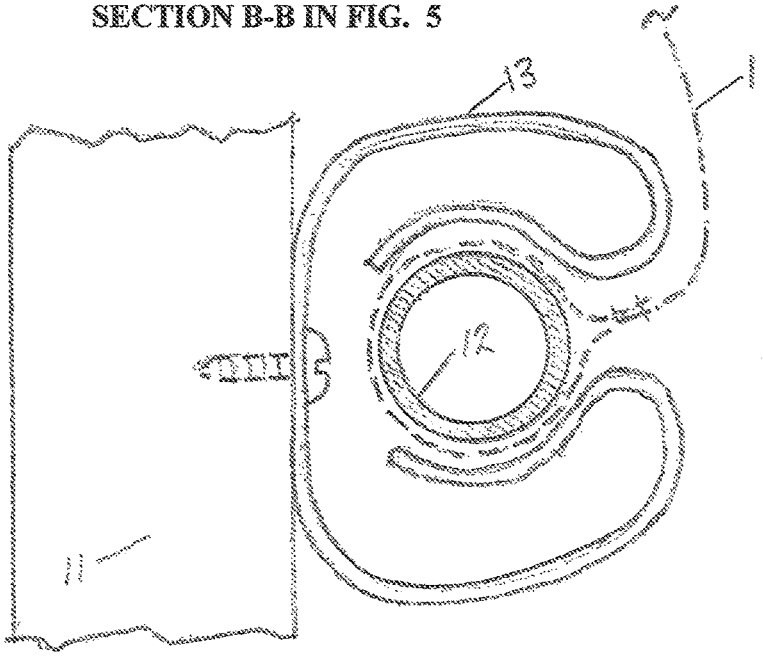
FIG. 6 shows Section B-B in FIG. 5. It illustrates one of the clamps holding the anchor rod to the headboard.

Referring to FIG. 1, the netting (1) is attached to the horizontal rod (2) and the headboard (11) of the bed (4). FIG. 5 shows how the netting (1) is attached to the back of the headboard (11) by an anchor rod (12) that passes through a loop in the netting (1). The anchor rod (12) is secured by clamps (13) attached to the headboard (11). FIG. 6 shows Section B-B in FIG. 5 and one of the clamps (13) It also shows the loop in the netting (1) through which the anchor rod (12) passes.

Figure 7:
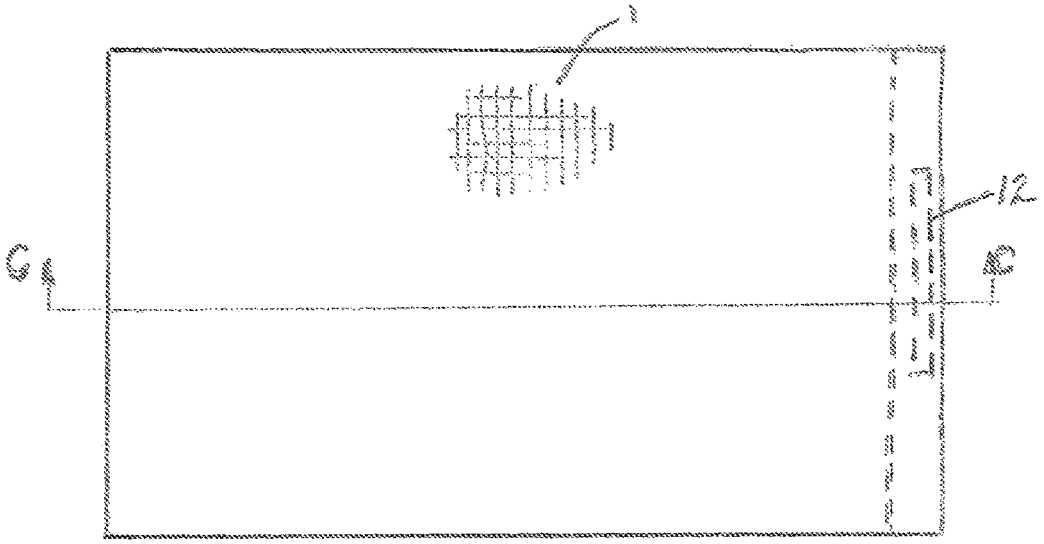
FIG. 7 shows the netting laid out before draping it over the articulated frame and the headboard. It also shows the anchor rod inserted into a loop at the end of the netting.
Figure 8:
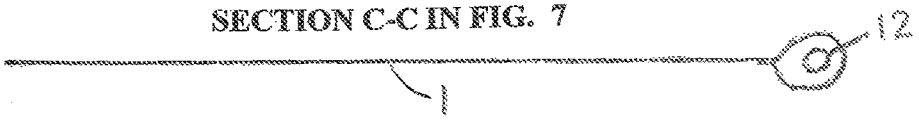
FIG. 8 shows Section C-C in FIG. 7. It shows how the netting is looped around the anchor rod.

FIG. 7 shows the netting (1) ready to be draped on the articulated frame and the headboard (11). The width of the netting (11) must be greater than the width of the bed (4) so as to ensure that the protected space under the netting is closed at the sides of the bed (4) when the netting (1) is deployed. The netting (1) must be long enough to ensure that, when the articulated frame is deployed, the netting (1) drapes onto the top of the bed (4), thereby completing the closure of the protected space as shown in FIG. 1. FIG. 8 shows Section C-C in FIG. 7 and the loop in the netting (1) through which the anchor rod (12) passes.

Figure 9:
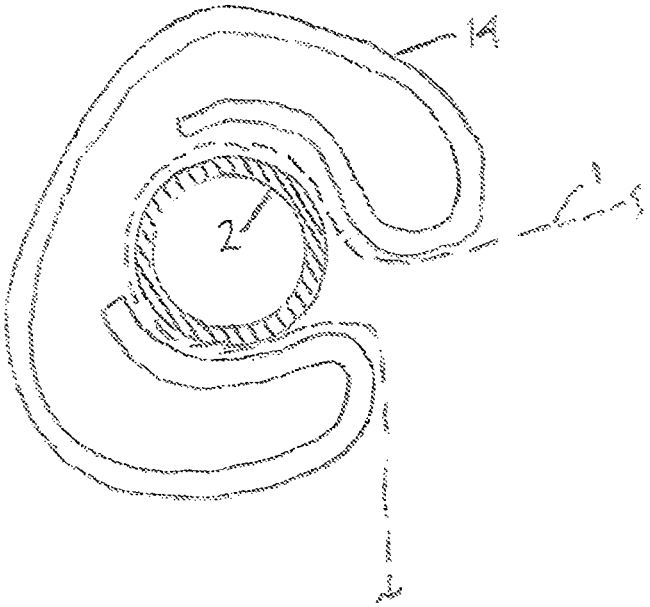
FIG. 9 shows Section A-A in FIG. 1. It illustrates the detail of the attachment of the netting to the horizontal rod by clamps.
Figure 10:
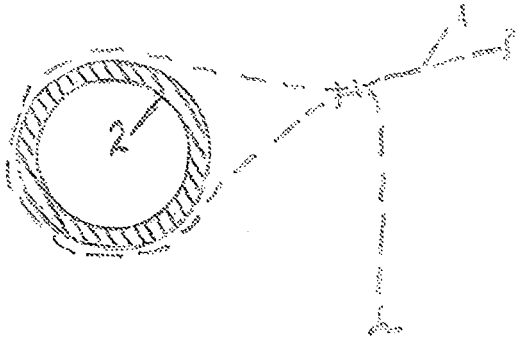
FIG. 10 shows Section A-A in FIG. 1. It illustrates the detail of an alternative means of attaching the netting to the horizontal rod by a loop in the netting.

FIG. 9 shows Section A-A in FIG. 1 and one of the clamps (14) that secures the netting (1) to the horizontal rod (2). Two or more clamps (14) are adequate for that purpose. FIG. 10 shows Section A-A in FIG. 1 and an alternative to using clamps (14). It shows a loop in the netting through which the horizontal rod (2) passes. In this alternative the loop must provide openings (not shown) to permit the connection of the legs (3) to the horizontal rod (2). Other obvious means of attaching the netting to the horizontal rod (2) and anchor rod (12) may be used, such as decorative ribbon ties, string, or Velcro. Such alternative means are considered to be within the scope of this invention.

Figure 11:
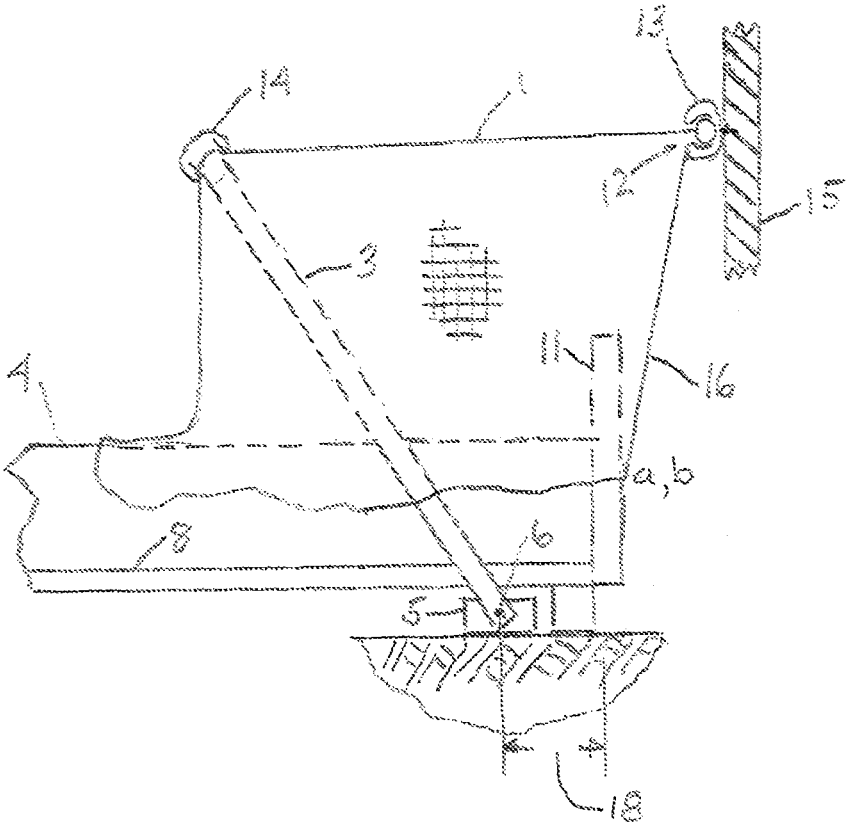
FIG. 11 shows the attachment of the netting to a wall behind the head of the bed using an anchor rod clamped to the wall. It also shows a back flap that prevents mosquitoes from entering the protected space by way of the space between the bed and the wall.
Figure 12:
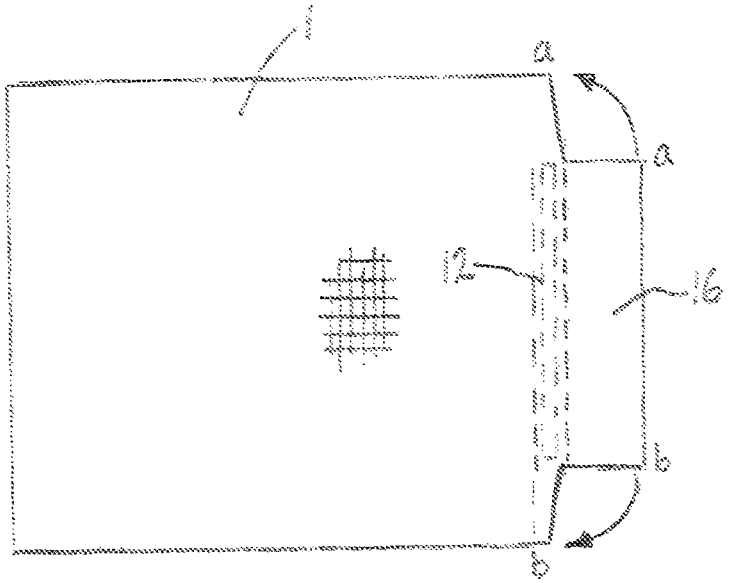
FIG. 12 shows a schematic of the layout of the netting and the back flap.

FIG. 11 shows the attachment of the netting (1) to a wall (15) behind the head of the bed (4) as an alternative to attachment of the netting (1) to the headboard (11). It is necessary to close the gap between the wall (15) and the bed (4) to prevent mosquitoes from entering the protected space from behind the head of the bed (4). For that reason, a back flap (16) must be included. The back flap (16) can be made of the netting material or any other cloth material. FIG. 12 shows a schematic of the netting (1) laid out flat and shows the back flap (16). Points "a" must be pinned or sewn together as well as Points "b". While this appears somewhat complex, it is quite easy to accomplish after the netting (1) and back flap (16) are in place and temporarily held together by safety pins or the like. Cutting the back flap (16) to the shape indicated in FIG. 12 can be accomplished after the netting (1) and back flap (16) are in place.

Figure 13:
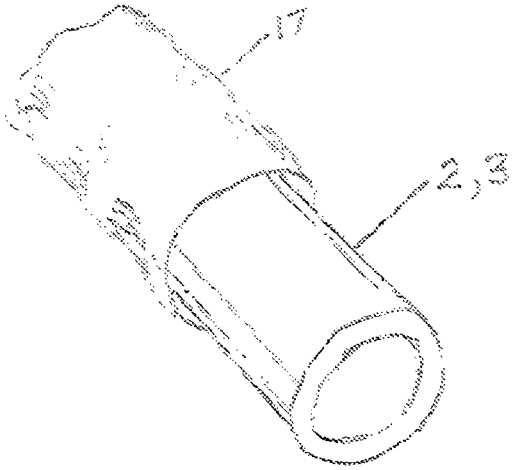
FIG. 13 shows a decorative sleeve that slips over the legs and horizontal rod.

FIG. 13 shows a decorative sleeve (17) covering the horizontal rod (2) and legs (3) of the articulated frame. The material used can have a color and pattern that coordinates with the bedding material or room decor.

The clamps (13 and 14) secure the netting to the horizontal rod (2) and the anchor rod (12) by pinching the netting (1) against the rods (2 and 12). The clamps (13 and 14) shown are usually used to hang brooms and tools on a wall and are readily available in any hardware store. Their design is not part of this invention. Other clamps of different design may be used. One advantage of using clamps (14) to attach the netting to the horizontal rod (2) (see FIG. 9) rather than a loop in the netting (1) (see FIG. 10) is that the deployed position of the horizontal rod (2) can be easily adjusted.

The legs (3), horizontal rod (2), and anchor rod (12) are ideally fabricated with PolyVinyl Chloride (PVC) tubing, although other materials may be used. The legs (3) and the horizontal rod (2) can then be connected using two PVC elbows.

To deploy the netting (1), the individual lying on the bed pulls on the netting (1) at point P (See FIG. 2) toward the foot (19) of the bed thereby pulling the horizontal rod (2) and legs (3) into their deployed position as depicted in FIG. 1. This process limits the chance that a transient mosquito in the area will be entrapped in the protected space To retract the articulated frame, the horizontal rod (2) is simply pushed back to its retracted position as depicted in FIG. 2. Both the deployment and retraction can be done by the individual lying on the bed, e.g., if you hear a mosquito, deploy the netting.

For those who must get up in the middle of the night, it is easy to exit and enter the protected space without retracting the articulated frame. It is easy to duck one's head under the horizontal rod (2) and leg (3) while getting out of bed. Certainly retracting the articulated frame is an alternative, but that may disturb a sleeping partner.

What I claimed is:

1. An articulated frame and mosquito netting assembly for use with a bed having a headboard and a bedframe for supporting a mattress, the articulated frame and mosquito netting assembly consisting of:

a single horizontal rod, having a first end and a second end, spanning a width of the bedframe;

a first leg having a top and a bottom, the top of the first leg attached to the first end of the horizontal rod;

a second leg having a top and a bottom, the top of the second leg attached to the second end of the horizontal rod, the first leg and the second leg being parallel;

the bottom of the first leg and the bottom of the second leg being pivotably attached at or below the bed frame via a pivot assembly, the pivot assembly located proximal to the headboard;

the mosquito netting draped over the bed and attached to the horizontal rod via a first attachment means and the mosquito netting attached to a location behind the headboard via a second attachment means, the mosquito netting creating a protected space between the articulated frame assembly, the headboard, and the mattress for preventing mosquitos from gaining access to an individual on the bed;

the articulated frame assembly operable in a deployed position and a retracted position, wherein in the deployed position the first leg and the second leg are angled away from the headboard to create the protected space, and in the retracted position the first leg and the second leg are angled toward the headboard, and wherein the first and second legs are configured to move to a vertical position between the deployed position and the retracted position.

2. The articulated frame and mosquito netting assembly disclosed in claim 1, wherein the first attachment means is composed of a loop in the mosquito netting, wherein the horizontal rod passes through the loop in the mosquito netting.

3. The articulated frame and mosquito netting assembly disclosed in claim 1, wherein the first attachment means is composed of clamps.

4. The articulated frame and mosquito netting assembly disclosed in claim 1, wherein the second attachment means is composed of an anchor rod and a loop in said mosquito netting wherein the anchor rod passes through the loop in the mosquito netting and the anchor rod is affixed to the location behind the headboard.

5. The articulated frame and mosquito netting assembly disclosed in claim 1, wherein the pivot assembly is composed of axles affixed to the bed frame.

6. The articulated frame and mosquito netting assembly disclosed in claim 1, wherein the pivot assembly is composed of axles attached to opposing ends of a board, wherein said board is located below the bedframe and spanning the width of the bedframe.

* * * * *